US007651398B2

(12) United States Patent
Ostendorff et al.

(10) Patent No.: US 7,651,398 B2
(45) Date of Patent: Jan. 26, 2010

(54) TOY VEHICLE RACEWAYS

(75) Inventors: Eric C. Ostendorff, Torrance, CA (US); Michael Nuttall, South Pasadena, CA (US); Harold Garner, El Segundo, CA (US); Steve P. Dunham, Venice, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/744,781

(22) Filed: May 4, 2007

(65) Prior Publication Data

US 2008/0014832 A1 Jan. 17, 2008

Related U.S. Application Data

(60) Provisional application No. 60/798,139, filed on May 4, 2006, provisional application No. 60/812,227, filed on Jun. 9, 2006, provisional application No. 60/813,017, filed on Jun. 12, 2006.

(51) Int. Cl.
*A63F 9/14* (2006.01)
*A63H 18/00* (2006.01)

(52) U.S. Cl. ..... 463/60; 446/444; 463/69

(58) Field of Classification Search ..... 463/58–60, 463/69; 446/444
See application file for complete search history.

(56) References Cited

U.S. PATENT DOCUMENTS

| | | | | |
|---|---|---|---|---|
| 738,586 | A | 9/1903 | Wilson | |
| 1,462,189 | A * | 7/1923 | Brooker | 463/60 |
| 1,493,649 | A | 5/1924 | Schulz | |
| 1,662,162 | A | 3/1928 | Nestor | |
| 1,914,116 | A | 6/1933 | Ford | |
| 2,171,634 | A | 9/1939 | Rexford et al. | |
| 2,198,306 | A | 4/1940 | Fisher | |
| 2,401,468 | A | 6/1946 | Duffy | |
| 2,616,630 | A | 11/1952 | Michele | |
| 2,618,437 | A | 11/1952 | Matthaeis, Jr. | |
| 2,726,869 | A | 12/1955 | Schulte | |
| 2,736,556 | A * | 2/1956 | Dasher | 463/69 |
| 2,853,301 | A * | 9/1958 | Glass | 463/69 |
| 2,998,196 | A | 8/1961 | Eenigenburg, Jr. | |
| 3,074,200 | A | 1/1963 | Ziegenfuss | |
| D197,616 | S | 3/1964 | Dunbar | |

(Continued)

OTHER PUBLICATIONS

International Search Report and Written Opinion for Application No. PCT/US2007/068306.

*Primary Examiner*—Gene Kim
*Assistant Examiner*—Alyssa M Hylinski
(74) *Attorney, Agent, or Firm*—Kolisch Hartwell, P.C.

(57) ABSTRACT

Toy raceways and finish line apparatuses for toy raceways are disclosed. Toy raceways may include a plurality of hingedly coupled multi-lane track segments, a starting apparatus, and a finish line apparatus. The plurality of hingedly coupled multi-lane track segments may be configured to foldably transition between a first configuration and a second configuration. In the first configuration, the plurality of hingedly coupled multi-lane track segments may be aligned to provide a multilane toy raceway, which may have a first end and a second end. In the second configuration, the plurality of hingedly coupled multi-lane track segments may produce a stack of folded track segments. The starting apparatus may be disposed proximate the first end of the toy raceway, and the finish line apparatus may be disposed proximate the second end of the toy raceway.

21 Claims, 7 Drawing Sheets

U.S. PATENT DOCUMENTS

| | | | | | |
|---|---|---|---|---|---|
| D204,468 | S | | 4/1966 | Smedley et al. | |
| 3,315,632 | A | * | 4/1967 | Hyden | 116/223 |
| 3,376,844 | A | * | 4/1968 | Wood | 116/223 |
| 3,502,332 | A | * | 3/1970 | Wolf | 463/69 |
| 3,542,366 | A | | 11/1970 | Schocker | |
| 3,618,947 | A | * | 11/1971 | Cooper et al. | 463/60 |
| 3,648,454 | A | | 3/1972 | Morrison | |
| 3,658,333 | A | * | 4/1972 | Carcel | 463/69 |
| 3,667,672 | A | * | 6/1972 | Kennedy et al. | 235/98 B |
| 3,674,269 | A | * | 7/1972 | Cooper et al. | 463/60 |
| 3,712,615 | A | | 1/1973 | Staats et al. | |
| 3,777,394 | A | | 12/1973 | Staats et al. | |
| 3,827,693 | A | | 8/1974 | Barlow et al. | |
| D233,620 | S | | 11/1974 | Seki | |
| 3,860,237 | A | | 1/1975 | Cooper et al. | |
| 3,970,309 | A | | 7/1976 | Sato | |
| 4,077,628 | A | | 3/1978 | Hebert | |
| 4,108,437 | A | | 8/1978 | DeAnda et al. | |
| 4,273,332 | A | * | 6/1981 | Buck et al. | 463/60 |
| 4,285,157 | A | * | 8/1981 | Lambert | 446/76 |
| 4,349,983 | A | | 9/1982 | Kilroy et al. | |
| 4,605,229 | A | | 8/1986 | McKay | |
| 4,715,602 | A | * | 12/1987 | May et al. | 463/60 |
| 4,767,053 | A | | 8/1988 | Cook et al. | |
| 4,872,680 | A | | 10/1989 | Dennis | |
| 4,937,207 | A | | 6/1990 | Simmell et al. | |
| D344,104 | S | | 2/1994 | Yen | |
| 5,452,893 | A | | 9/1995 | Faulk et al. | |
| 5,651,736 | A | | 7/1997 | Myers | |
| 5,676,586 | A | | 10/1997 | James | |
| 5,813,351 | A | * | 9/1998 | Chen | 104/60 |
| 6,601,774 | B1 | | 8/2003 | Kasimoff | |
| 6,647,893 | B1 | * | 11/2003 | Fugitt et al. | 104/69 |
| 6,913,508 | B2 | | 7/2005 | Hornsby et al. | |
| 2002/0195502 | A1 | | 12/2002 | Delage | |
| 2004/0238655 | A1 | | 12/2004 | Monk | |

* cited by examiner

TOY VEHICLE RACEWAYS

RELATED APPLICATIONS

This application claims priority under 35 U.S.C. §119(e) to U.S. Provisional Patent Application Ser. Nos. 60/798,139, which was filed on May 4, 2006 and is entitled "Toy Vehicle Raceways;" 60/812,227, which was filed on Jun. 9, 2006 and is entitled "Toy Vehicle Raceways;" and 60/813,017, which was filed on Jun. 12, 2006 and is entitled "Multiple Lane Toy Vehicle Raceway." The complete disclosures of the above-identified patent applications are hereby incorporated by reference for all purposes.

TECHNICAL FIELD

The present disclosure relates generally to toy raceways and, more particularly, to toy vehicle raceways having racing order indicators.

BACKGROUND OF THE DISCLOSURE

Examples of toy raceways are disclosed in U.S. Pat. Nos. 6,913,508; 6,647,893; 6,099,380; 5,651,736; 4,937,207; 4,715,602; 4,349,983; 3,712,615; 3,502,332; 3,376,844; 3,315,632; and 1,662,162. Examples of finish order indicators are disclosed in U.S. Pat. Nos. 5,651,736; 4,715,602; 3,618,947; 3,502,332; 3,376,844; 3,315,632; and 1,662,162. The disclosures of these and all other publications referenced herein are incorporated by reference in their entirety for all purposes.

SUMMARY OF THE DISCLOSURE

The present disclosure is directed to toy raceways and finish line apparatuses for toy raceways.

In some examples, a toy raceway may include a plurality of hingedly coupled multi-lane track segments, a starting apparatus, and a finish line apparatus. The plurality of hingedly coupled multi-lane track segments may be configured to foldably transition between a first configuration and a second configuration. In the first configuration, the plurality of hingedly coupled multi-lane track segments may be aligned to provide a multilane toy raceway, which may have a first end and a second end. In the second configuration, the plurality of hingedly coupled multi-lane track segments may produce a stack of folded track segments. The starting apparatus may be disposed proximate the first end of the toy raceway, and the finish line apparatus may be disposed proximate the second end of the toy raceway.

In some examples, a toy raceway may include a track, a starting apparatus, and a racing order apparatus. The track may have a first end and a second end and may include a plurality of parallel racing surfaces. The track may include a first track segment and a second track segment. The first track segment may extend from a first end to a second end. The second track segment may extend from a first end to a second end. The second end of the first track segment may be pivotably connected to the first end of the second track segment. The first track segment may be configured to pivot relative to the second track segment about a first axis that is parallel to the racing surfaces. The starting apparatus may be disposed proximate the first end of the track. The starting apparatus may be configured to simultaneously release a plurality of vehicles for travel along the plurality of parallel racing surfaces. The racing order apparatus may be disposed intermediate the starting apparatus and the second end of the track.

The racing order apparatus may include a support structure and a plurality of paddles. The support structure may be pivotably mounted to one of the first and second track segments and may have a racing order indicating region. The plurality of paddles may be pivotably mounted to the support structure. Each paddle may be adapted to pivot between first and second positions. In the first position, each paddle may at least partially obstruct a corresponding one of the parallel racing surfaces. Each of the plurality of paddles may be configured to move from the first position toward the second position in response to one of the vehicles contacting the paddle while traveling on the corresponding racing surface. In the second position, at least a portion of the paddle may be disposed in the racing order indicating region. The respective ones of the portions of the plurality of paddles may be arranged in the racing order indicating region in an order, which may correspond to the order in which the plurality of vehicles contacted the respective paddles.

In some examples, a finish line apparatus for a toy raceway, which may include a plurality of lanes that may be adapted to provide a racing surface for a plurality of racing elements, may include a support structure and a plurality of contact members. The support structure may extend across the plurality of lanes and have a finish order display region. The plurality of contact members may extend from the support structure, and each contact member may be configured for movement between first and second positions. In the first position, each contact member may at least partially obstruct a corresponding one of the lanes. Each of the plurality of contact members may be configured to transition from the first position toward the second position in response to a racing elements contacting the contact member while traveling in the corresponding lane. In the second position, at least a portion of the contact member may be disposed in the finish order display region. The respective portions of the plurality of contact members may be arranged in the finish order display region in an order, which may correspond to the order in which the racing elements contacted the respective contact elements.

DETAILED DESCRIPTION

Figure 1:
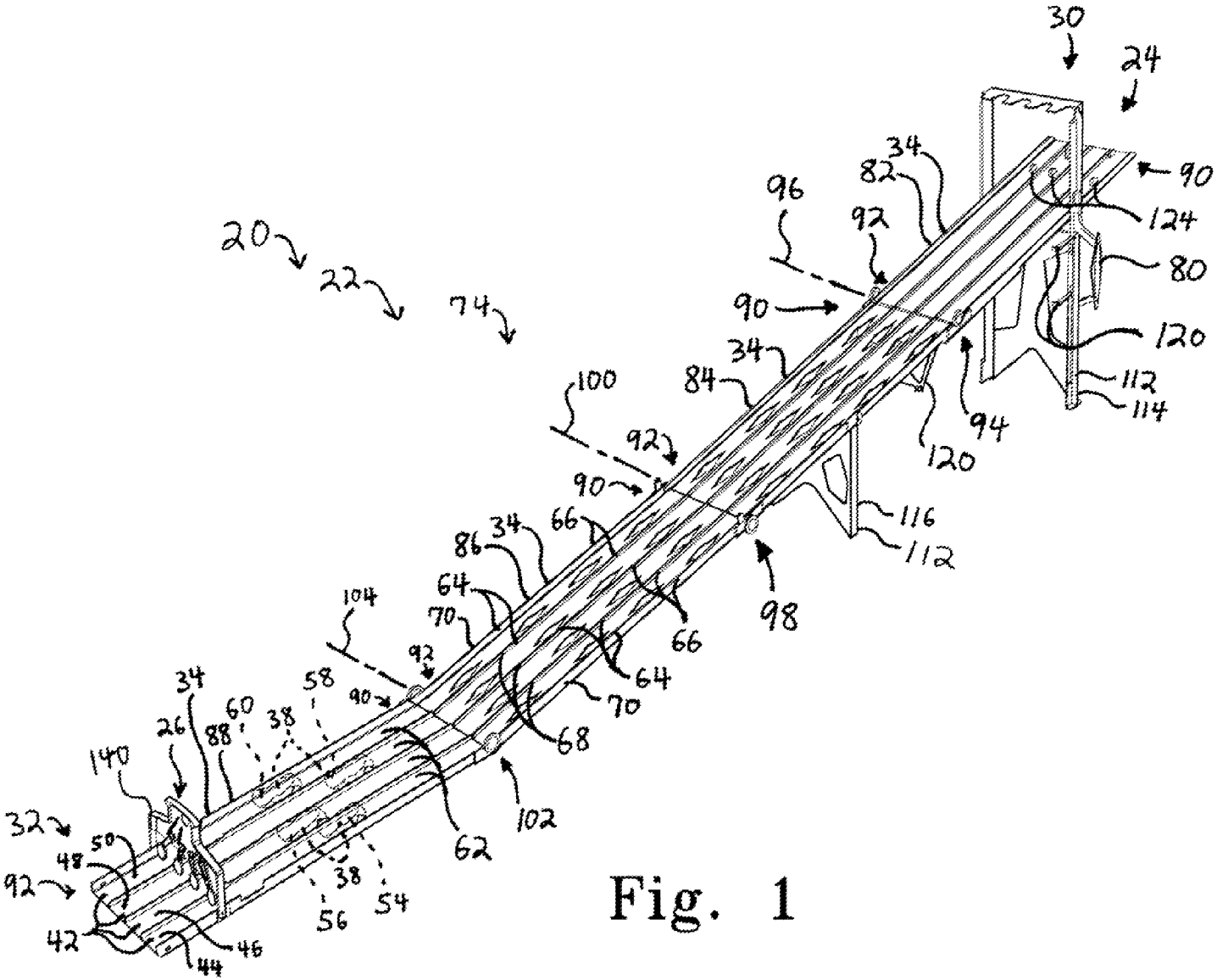
FIG. 1 is a perspective view of a toy vehicle raceway in an open configuration.

A nonexclusive illustrative example of a toy vehicle raceway is shown generally at 20 in FIGS. 1-4. Unless otherwise specified, toy vehicle raceway 20 may, but is not required to, contain at least one of the structure, components, functionality, and/or variations described, illustrated, and/or incorporated herein. Toy raceway 20 may include a track 22, a starting apparatus 24, and at least one racing order apparatus 26. The track 22 may extend from a first end 30 to a second end 32 and may include a plurality of track segments 34.

The track 22 may be configured for use with a plurality of racing elements 38. The racing elements 38 may be any object that may be adapted for travel along the track 22, such as between the first end 30 and the second end 32. In some nonexclusive illustrative examples, the racing elements may themselves be unpowered, such as where the racing elements may be propelled along the track 22 by an external driving force. For example, the first end 30 of the track 22 may be elevated relative to the second end 32 such that the racing elements 38 may be propelled along the track 22 by gravity. Other nonexclusive illustrative examples of external driving forces may include a stream of air or fluid directed against the racing elements. Nonexclusive illustrative examples of unpowered racing elements may include toy vehicles, such as miniature cars, or other objects, such as balls, which are capable of rolling, tumbling, and/or sliding along the track 22. In some nonexclusive illustrative examples, the racing elements may themselves be powered. For example, the racing elements may be electrically powered toy vehicles or cars, which may receive electric power from an internal source, such as a battery, and/or from an external source, such as a pair of electrical contacts extending along the track 22.

The plurality of track segments 34 may be configured as multi-lane track segments such that the toy raceway 20 is a multi-lane toy raceway. For example, as shown in the nonexclusive illustrative example presented in FIG. 1, the plurality of track segments 34 may each include a plurality of parallel racing surfaces or lanes 42, along which respective ones of the plurality of racing elements 38 may travel. Each of the plurality of parallel racing surfaces or lanes 42 may extend from the first end 30 of the track 22 to the second end 32 of the track 22. When toy raceway 20 is configured as a multi-lane toy raceway, it may include any suitable number of spaced apart racing surfaces or lanes, such as two, three, four, or even five or more lanes. For example, as shown in the nonexclusive illustrative example presented in FIG. 1, the plurality of track segments 34 may each include a first lane 44, a second lane 46, a third lane 48, and a fourth lane 50, along which a first racing element 54, a second racing element 56, a third racing element 58, and a fourth racing element 60, respectively, may travel.

In some nonexclusive illustrative examples, one or more of the plurality of racing surfaces or lanes 42 may be configured to guide respective ones of the plurality of racing elements 38 along the track 22. As such, the plurality of racing surfaces or lanes 42 may include at least one traveling surface 62 along which a racing element may travel and at least one guiding structure 64, which may at least partially maintain the racing element along the at least one traveling surface 62. For example, as shown in the nonexclusive illustrative example presented in FIG. 1, the plurality of track segments 34 may each include a plurality of upstanding parallel ribs 66, which may be configured to define a plurality of spaced apart lanes 42 for the plurality of racing elements 38. In some nonexclusive illustrative examples, the upstanding parallel ribs 66 may include one or more intermediate ribs 68 and one or more peripheral ribs 70. For example, as shown in the nonexclusive illustrative examples presented in FIGS. 1 and 5, the intermediate ribs 68 may separate adjacent ones of the lanes 42, and the peripheral ribs 70 may define the lateral edges of the track segment 34. In some nonexclusive illustrative examples, the peripheral ribs 70 may have increased depth relative to the intermediate ribs 68, as shown in FIG. 1.

Figure 5:
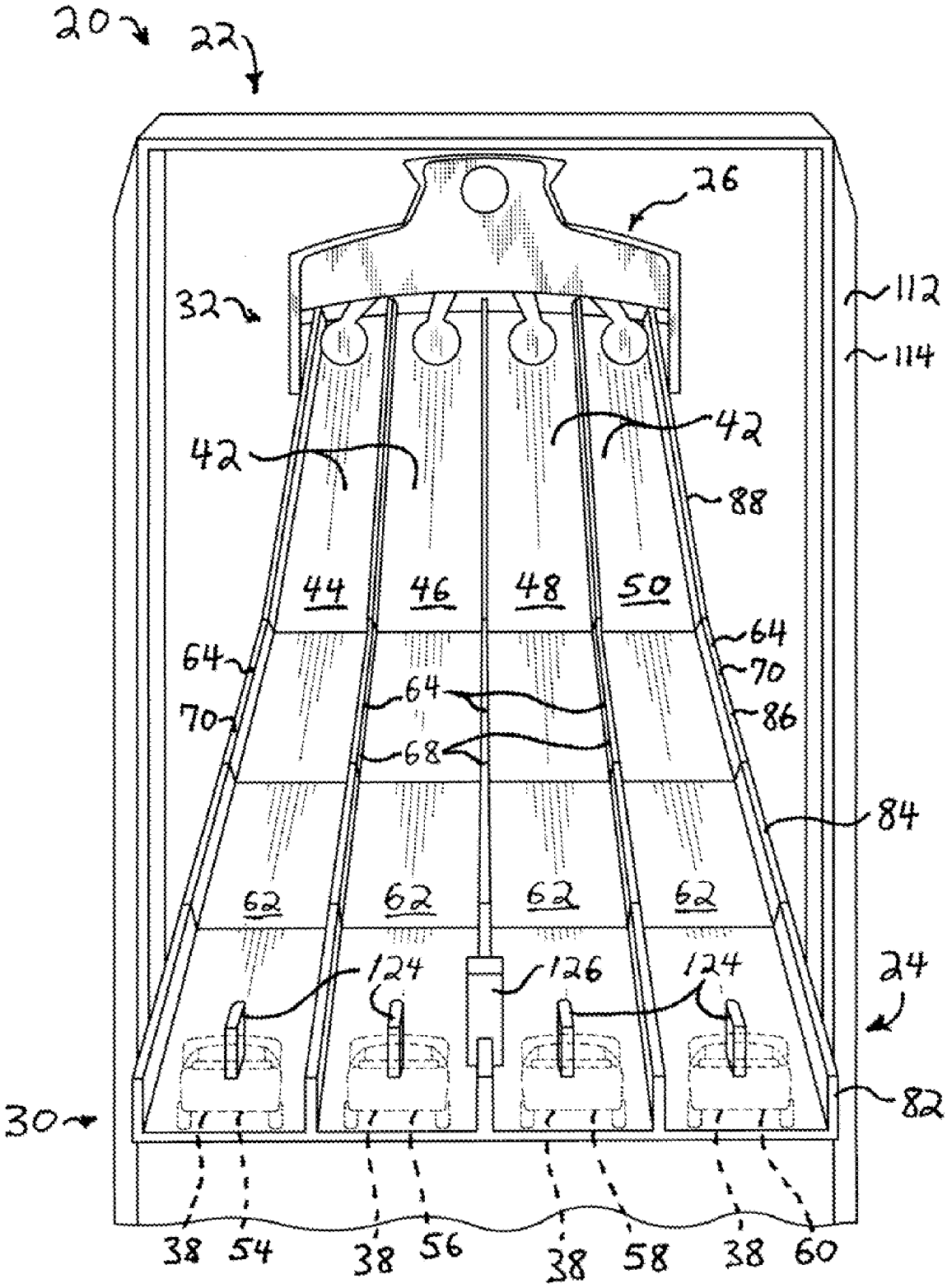
FIG. 5 is a detail view of a start region of another illustrative example of a toy vehicle raceway.

The U-shaped profile of the lanes 42 shown in the nonexclusive illustrative examples presented in FIGS. 1 and 5 may serve to guide a racing element as it travels along the lane 42, with the pair of ribs 66 serving as a guiding structure 64. In some nonexclusive illustrative examples, rather than a pair of guiding structures 64 disposed on opposing sides of the traveling surface 62, the guiding structure 64 may be in the form of a ridge running down the center of the lane, such as where the racing element includes one or more pairs of wheels that straddle the ridge.

Figure 2:
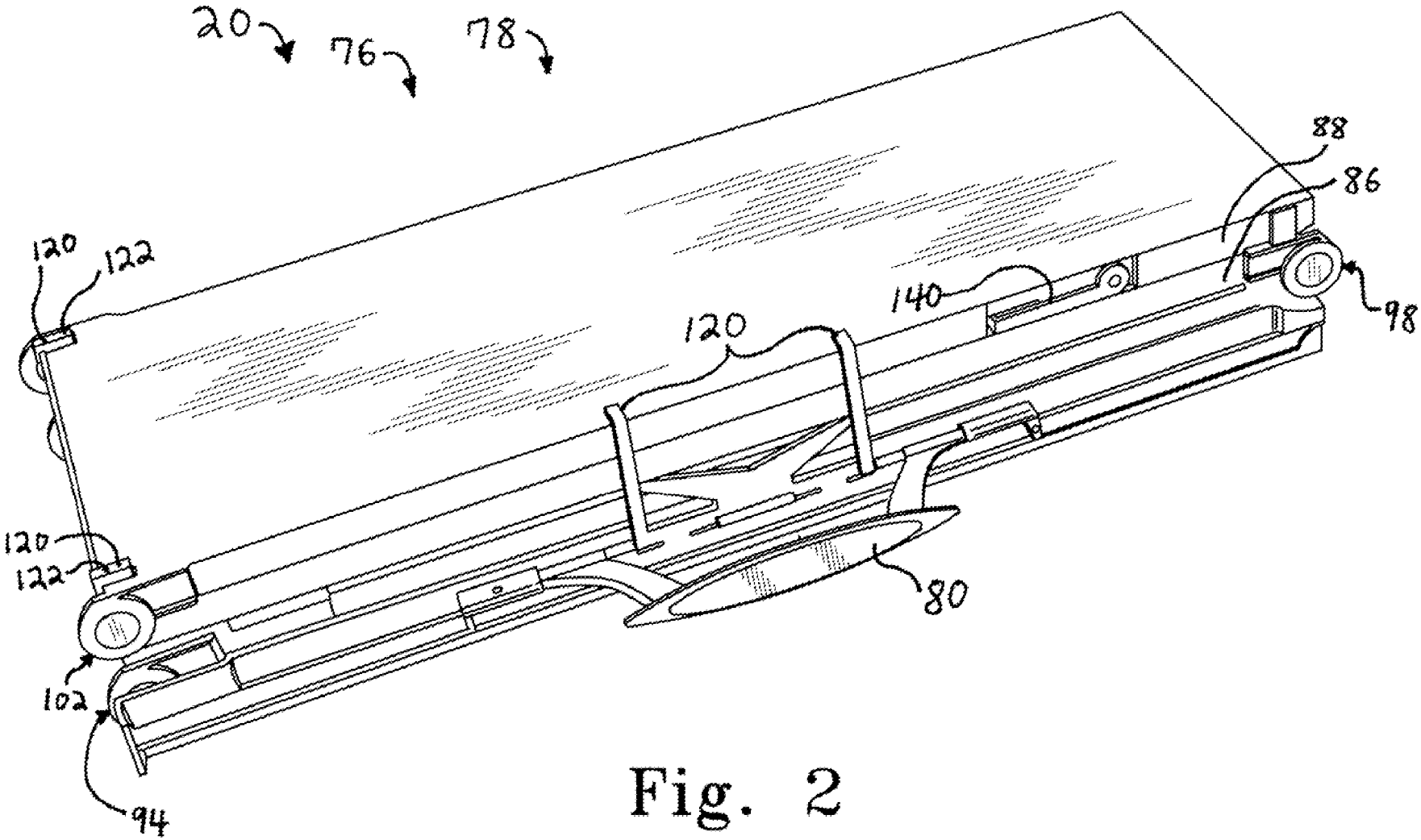
FIG. 2 is a perspective view of the toy vehicle raceway of FIG. 1 in a closed or folded configuration.
Figure 3:
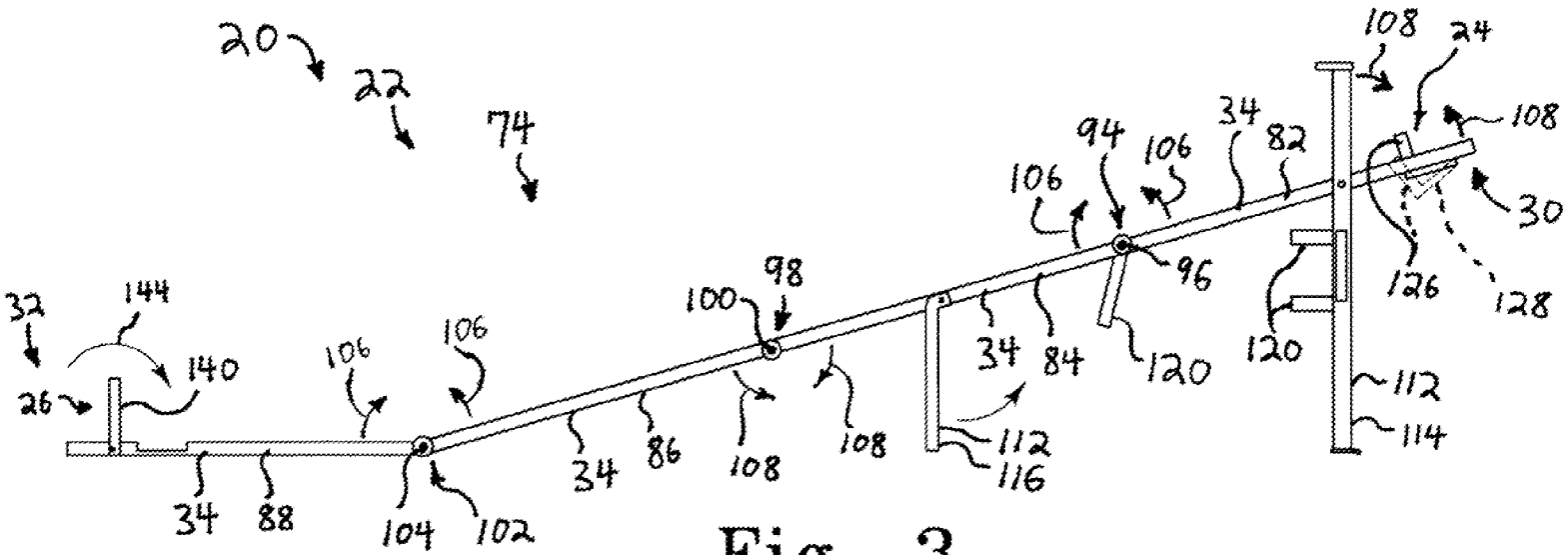
FIG. 3 is a side elevation view of the toy vehicle raceway of FIG. 1 in an open configuration.

The track 22 may be configured to transition between a first configuration 74 and a second configuration 76. A nonexclusive illustrative example of a first configuration 74 of track 22 is shown in FIGS. 1 and 3, where the plurality of track segments 34 are aligned to provide a toy vehicle raceway 20 having track 22 that extends from a first end 30 to a second end 32. A nonexclusive illustrative example of a second configuration 76 of track 22 is shown in FIG. 2, where the plurality of track segments 34 are arranged to produce a stack 78 of track segments. The relatively compact nature of the track 22 while in the second configuration 76 may provide the toy vehicle raceway 20 with enhanced transportability, which may be further enhanced in some nonexclusive illustrative examples by the inclusion of one or more carrying handles 80.

In some nonexclusive illustrative examples, the track 22 may be configured to transition between the first configuration 74 and the second configuration 76 by folding. For example, adjacent ones of the plurality of track segments 34 may be hingably or pivotably coupled such that the adjacent ones of the plurality of track segments may pivot relative to each other. As shown in the nonexclusive illustrative example presented in FIGS. 1-4, the track 22 may include first 82, second 84, third 86 and fourth 88 track segments, each of which extends from a first end 90 to a second end 92. The second end 92 of the first track segment 82 may be connected to the first end 90 of the second track segment 84 via a first hinged connection 94 such that the second track segment 84 is configured to pivot about a first axis 96 relative to the first track segment 82. The second end 92 of the second track segment 84 may be connected to the first end 90 of the third track segment 86 via a second hinged connection 98 such that the third track segment 86 is configured to pivot about a second axis 100 relative to the second track segment 84. The second end 92 of the third track segment 86 may be connected to the first end 90 of the fourth track segment 88 via a third hinged connection 102 such that the fourth track segment 88 is configured to pivot about a third axis 104 relative to the third track segment 86. As shown in the nonexclusive illustrative example presented in FIGS. 1-4, at least one of the first 96, second 100, and third 104 axes may be parallel to a plane at least partially defined by the traveling surfaces 62 of the lanes 42 and/or to one or more of the remaining ones of the first 96, second 100, and third 104 axes.

Figure 4:
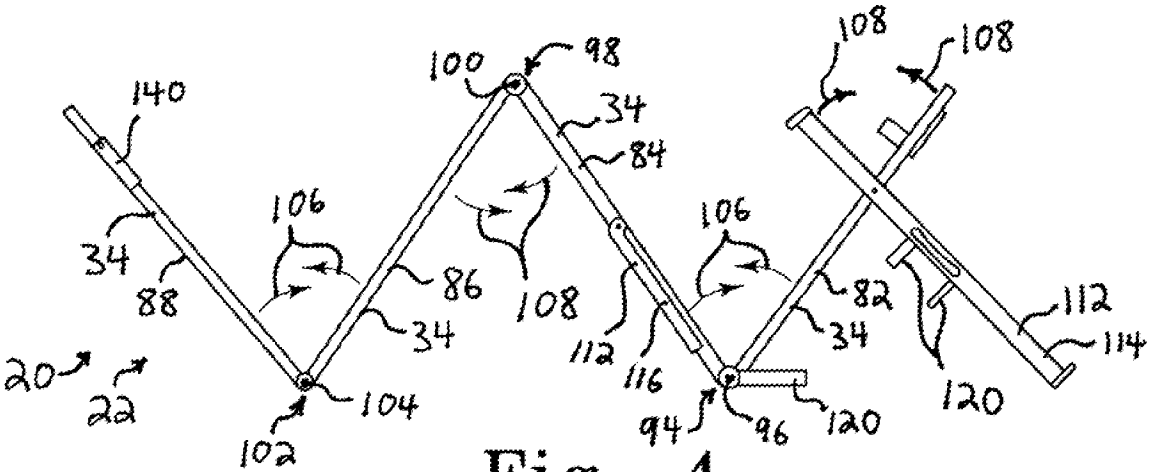
FIG. 4 is a side elevation view of the toy vehicle raceway of FIG. 1 in a partially folded configuration.

In some nonexclusive illustrative examples, at least one of the first 94, second 98, and third 102 hinged connections may be configured to pivot in a rotational direction that is opposite to a rotational direction in which one or more of the remaining ones of the first 94, second 98, and third 102 hinged connections pivots. For example, as shown in the nonexclusive illustrative example presented in FIG. 4, the first and third hinged connections 94, 102 may be configured to pivot in a first rotational direction 106 that is opposite to a second rotational direction 108 in which the second hinged connection 98 pivots such that the first and third hinged connections 94, 102 fold in a direction that is opposite to that in which the second hinged connection 98 folds. In such a nonexclusive illustrative example, the first 82, second 84, third 86 and fourth 88 track segments are configured to transition from the first configuration 74, as shown in FIGS. 1 and 3, to the second configuration 76, as shown in FIG. 2, by folding in a Z-fold, zig-zag, or accordion-like manner, as shown in FIG. 4, due to the adjacent ones of the first 94, second 98, and third 102 hinged connections pivoting in opposite rotational directions. In other nonexclusive illustrative examples, the first 82, second 84, third 86 and fourth 88 track segment may be configured to transition from the first configuration 74, as shown in FIGS. 1 and 3, to a folded configuration 76, such as one similar to that shown in FIG. 2, by folding in a nesting or spiral manner in which adjacent ones of the first 94, second 98, and third 102 hinged connections pivot in the same rotational direction such that successive ones of the track segments fold in on each other. In some nonexclusive illustrative examples, one or more of the first 94, second 98, and third 102 hinged connections pivots may be configured to prevent rotation in a particular rotational direction and/or rotation beyond a predetermined angle, such as 180 degrees.

In some nonexclusive illustrative examples, the toy vehicle raceway 20 may include at least one support member 112. The at least one support members 112 may be configured to at least partially elevate and/or support the first end 30 of the track 22 relative to the second end 32 of the track 22. For example, as shown in the nonexclusive illustrative example presented in FIGS. 1-4, the toy vehicle raceway 20 may include a start line support member 114, which may be hingably or pivotably connected to the first track segment 82. In some nonexclusive illustrative examples, start line support member 114 may be configured to pivot in the second rotational direction 108 relative to the first track segment 82 during transition of the track 22 between the first configuration 74 and the second configuration 76. In some nonexclusive illustrative examples, the handle 80 may be disposed on the start line support member 114. In some nonexclusive illustrative examples, the toy vehicle raceway 20 may include one or more intermediate support members 116, which may be hingably or pivotably connected to one of the plurality of track segments 34, such as the second track segment 84, as shown in FIGS. 1, 3 and 4.

In some nonexclusive illustrative examples, the toy vehicle raceway 20 may include at least one latching member 120. The at least one latching member 120 may be configured to at least partially retain the plurality of track segments 34 in the second configuration 76. For example, as shown in the nonexclusive illustrative example presented in FIGS. 1-4, the toy vehicle raceway 20 may include a latching member 120 that is pivotably connected to the second end 92 of the first track segment 82 and/or to the first end 90 of the second track segment 84, as shown in FIGS. 1, 3 and 4, and is configured to engage the first end 90 of the fourth track segment 88 when the plurality of track segments 34 are in the second configuration 76, as shown in FIG. 2. In some nonexclusive illustrative examples, the toy vehicle raceway 20 may include latching members 120 that extend from the start line support member 114, as shown in FIGS. 1, 3 and 4, and are configured to engage the fourth track segment 88 when the plurality of track segments 34 are in the second configuration 76, as shown in FIG. 2.

A nonexclusive illustrative example of a starting apparatus is shown generally at 24 in FIGS. 1, 3 and 5. Unless otherwise specified, starting apparatus 24 may, but is not required to, contain at least one of the structure, components, functionality, and/or variations described, illustrated, and/or incorporated herein. The starting apparatus 24 may be configured to selectively release a plurality of racing elements 38 for travel along respective ones of the plurality lanes 42, such as toward the second end 32 of the track 22.

The starting apparatus 24 may be disposed proximate the first end 30 of the track 22 and may include a plurality of retention/release members 124 and an activation member 126. In some nonexclusive illustrative examples, the starting apparatus 24 may be configured to selectively retain the plurality of racing elements 38 proximate the first end 30 of the track 22. For example, as shown in the nonexclusive illustrative examples presented in FIGS. 1 and 5, the plurality of retention/release members 124 may be configured as a plurality of tabs that project above the traveling surfaces 62 of the plurality of lanes 42. The plurality of retention/release members 124 may be operatively linked to the activation member 126 by a linking member 128, which may be below the first track segment 82, as shown in FIG. 3. In some nonexclusive illustrative examples, the linking member 128 may be pivotably attached to the first track segment 82, as suggested in FIG. 3. When the plurality of retention/release members 124 and the activation member 126 project above the traveling surfaces 62, the activation member 126 may be selectively urged toward the traveling surfaces 62, as suggested in FIG. 3, such that the plurality of retention/release members 124 may be lowered relative to the traveling surfaces 62, which may release the plurality of racing elements 38 for travel along the plurality lanes 42.

In some nonexclusive illustrative examples, the starting apparatus 24 may be configured to selectively simultaneously release a plurality of racing elements 38 for travel along respective ones of the plurality lanes 42. For example, the plurality of retention/release members 124 may be of similar height and/or the linking member 128 may be of an appropriate rigidity or stiffness such that the plurality of retention/release members 124 may be lowered relative to the traveling surfaces substantially concurrently.

Figure 6:
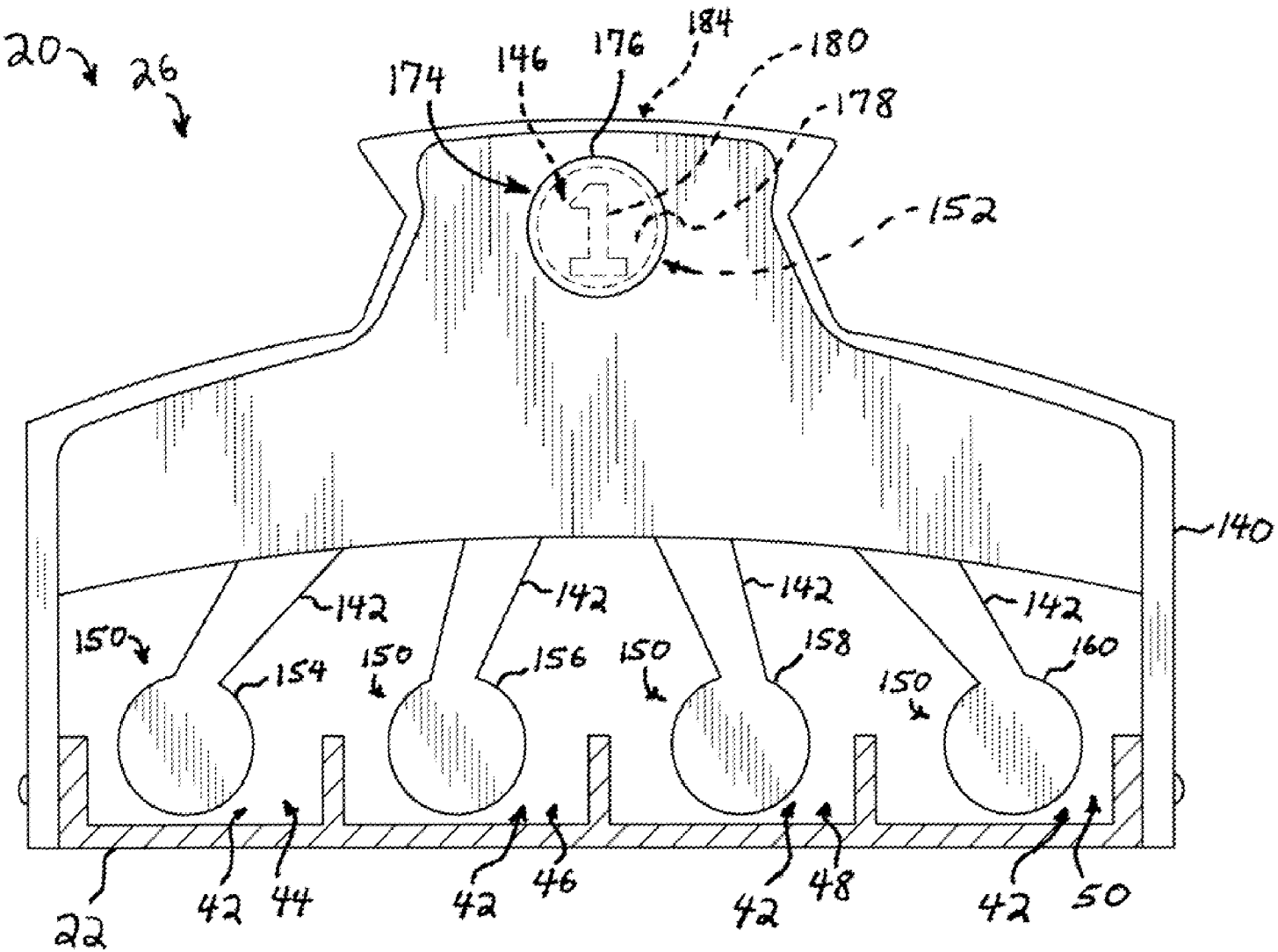
FIG. 6 is a front detail view of a finish line apparatus suitable for use with a toy vehicle raceway, such as the toy vehicle raceways of FIGS. 1 and 5.
Figure 7:
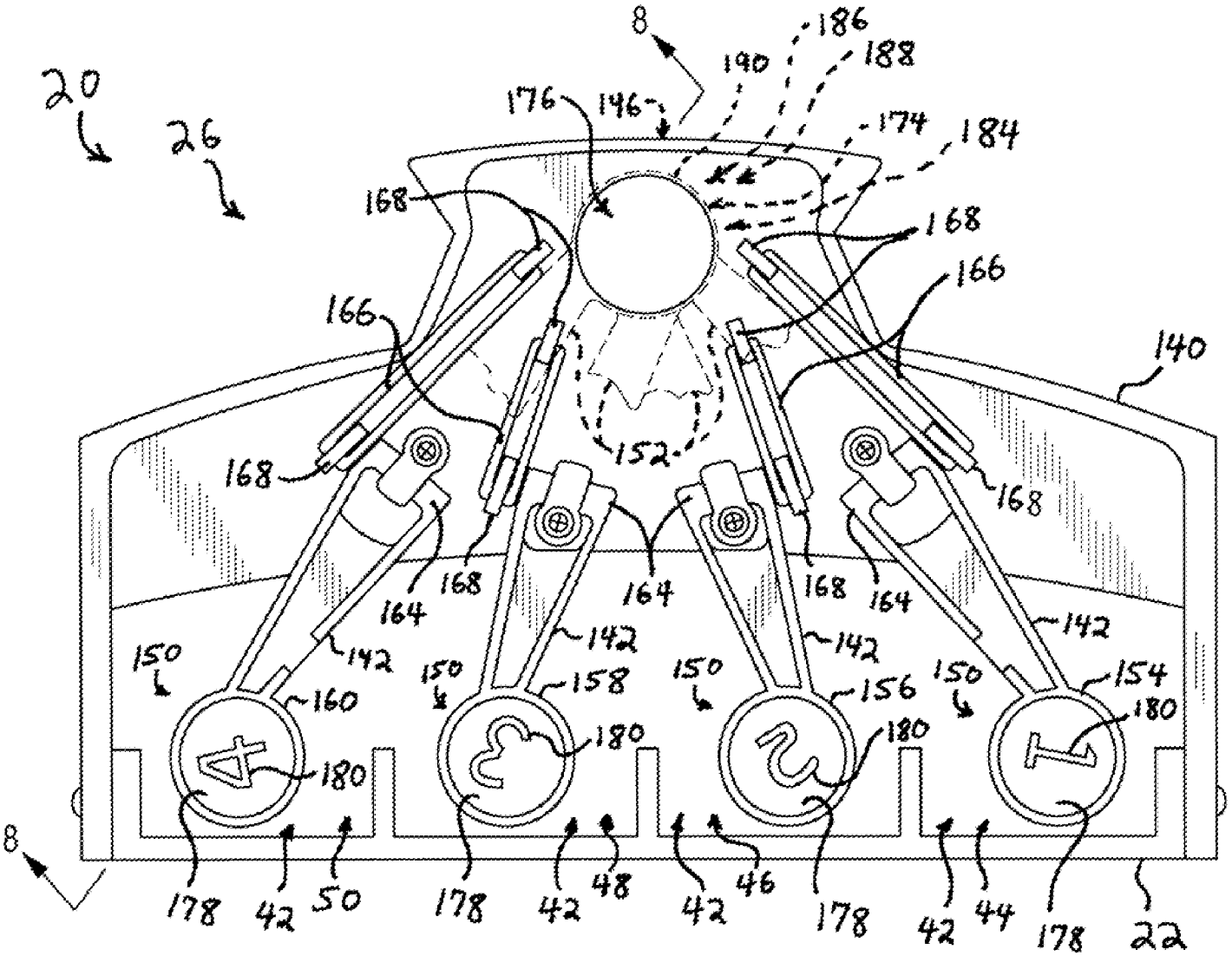
FIG. 7 is a rear view of the finish line apparatus of FIG. 6.
Figure 8:
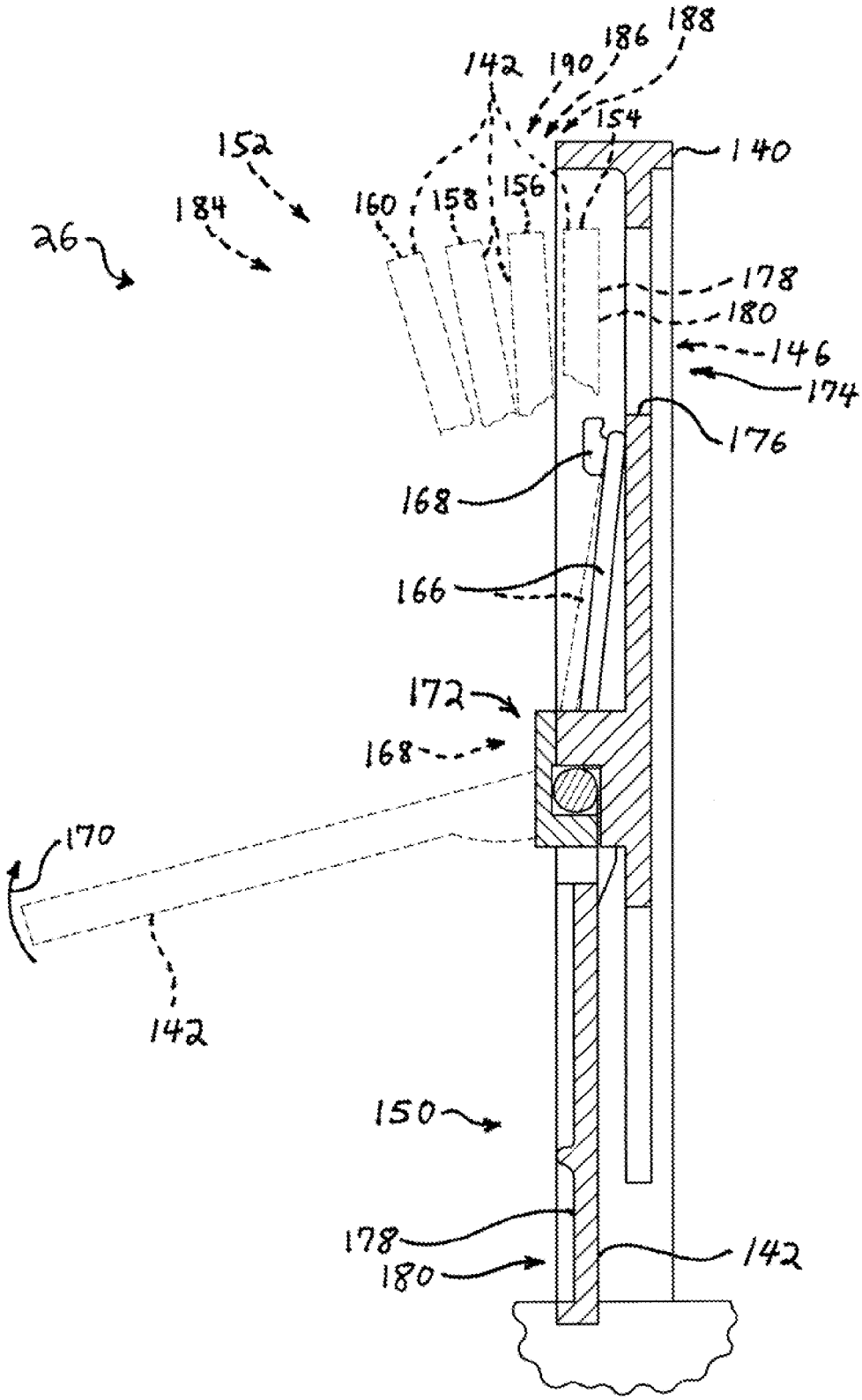
FIG. 8 is a partial section view of the finish line apparatus of FIG. 6, taken generally along line 8-8 in FIG. 7.

A nonexclusive illustrative example of a racing order apparatus is shown generally at 26 in FIGS. 6-8. Unless otherwise specified, racing order apparatus 26 may, but is not required to, contain at least one of the structure, components, functionality, and/or variations described, illustrated, and/or incorporated herein. The racing order apparatus 26 may include a support structure 140, which may extend across the plurality of lanes 42 of the track 22, and a plurality of contact members or paddles 142.

The support structure 140 may be mounted to one of the plurality of track segments 34 such that the racing order apparatus 26 is disposed intermediate the starting apparatus 24 and the second end 32 of the track 22. In some nonexclusive illustrative examples, the racing order apparatus 26 may be configured as a finish line apparatus. For example, as shown in the nonexclusive illustrative example presented in FIG. 1, the racing order apparatus 26 may be disposed proximate the second end 32 of the track 22. In some nonexclusive illustrative examples, the racing order apparatus 26 may be pivotably mounted to one of the plurality of track segments 34, such as to the fourth track segment 88, as shown in FIG. 1. Pivotably mounting the support structure 140 to one of the plurality of track segments 34 may permit folding of the support structure relative to the track 22, as indicated by arrow 144 in FIG. 3, such that the plurality of track segments 34 may be positioned in the second configuration 76, as shown in FIG. 2.

The racing order apparatus 26 may be configured to indicate which of the plurality of racing elements 38 traveling along the plurality of lanes 42 was the race leader at a predetermined point on the track 22. For example, the racing order apparatus 26 may provide an indication 146, which may be a first indication, of which of the plurality of racing elements 38 traveling along the plurality of lanes 42 was the first racing element to reach the racing order apparatus 26. When the racing order apparatus 26 is configured as a finish line apparatus, the first indication 146 may identify which of the plurality of racing elements 38 won a race by being the first racing element to reach the finish line apparatus.

As shown in the nonexclusive illustrative example presented in FIGS. 6-8, the plurality of paddles 142 may extend from the support structure 140 and may be configured for movement between a first position 150, as shown in solid lines in the nonexclusive illustrative example presented in FIGS. 6-8, and a second position 152, as shown dashed lines in the nonexclusive illustrative example presented in FIGS. 6-8. As shown in solid lines in FIGS. 6-8, when in the first position 150, each paddle 142 at least partially obstructs a corresponding one of the lanes 42, which obstruction may at least partially obstruct passage of a racing element traveling in the corresponding one of the lanes 42. For example, a first paddle 154 may at least partially obstruct the first lane 44, a second paddle 156 may at least partially obstruct the second lane 46, a third paddle 158 may at least partially obstruct the third lane 48, and a fourth paddle 160 may at least partially obstruct the fourth lane 50.

The paddles 142 may be configured to transition or move from the first position 150 to the second position 152 in response to one of the racing elements 38 contacting the paddle 142 while traveling in the corresponding lane 42. For example, a first paddle 154 may transition or move from the first position 150 to the second position 152 in response to the first racing element 54 contacting the first paddle 154 while traveling in the first lane 44. Further, by way of a nonexclusive illustrative example, if the first racing element 54 contacts the first paddle 154 before any of the remaining ones of the second 56, third 58 and fourth 60 racing elements contacts a respective one of the second 156, third 158 and fourth 160 paddles, the first paddle 154 may move to the second position 152 and provide an indication 146 that the first racing element 54 was the first to reach the racing order apparatus 26, as will be more fully described below.

In some nonexclusive illustrative examples, the paddles 142 may be configured to pivot between the first position 150 and the second position 152. For example, as shown in the nonexclusive illustrative example presented in FIGS. 6-8, a first end 164 of each paddle 142 may be pivotably mounted to the support structure 140.

In some nonexclusive illustrative examples, the plurality of paddles 142 may be biased toward the second position 152. As such, an elastic biasing member may be disposed between, and/or at least partially connect or link, each of the plurality of paddles 142 and the support structure 140. The elastic biasing member may be any suitable structure or element that may be adapted to urge the paddle 142 from the first position 150 to the second position 152, such as a spring, which may be a coil spring, a flexion or bending type spring, or an elastic loop such as a rubber band or an O-ring. For example, as shown in the nonexclusive illustrative example presented in FIGS. 7-8, the biasing member may be an elastic loop 166 that extends between appropriate engaging members, such as hooks 168, on each of the plurality of paddles 142 and the support structure 140. As shown in the nonexclusive illustrative example presented in FIGS. 7-8 where the paddles 142 are shown pivotably mounted to the support structure 140, the elastic loop 166 may be secured to paddle 142 proximate the first end 164 such that the elastic loop 166 induces a rotational moment into the paddle 142 that tends to urge the paddle 142 to pivot towards the second position 152, as indicated by arrow 170.

In some nonexclusive illustrative examples, the plurality of paddles 142 may be releasably retained in the first position 150. The plurality of paddles 142 may be releasably retained by any suitable mechanism such as a latch and/or an elastic biasing member. For example, as shown in the nonexclusive illustrative example presented in FIG. 8 where the paddles 142 are shown pivotably mounted to the support structure 140, the elastic loop 166 may be secured to the paddle 142 in such a manner as to create an over-center arrangement or condition 172 in the pivotable attachment of the paddle 142 to the support structure 140 when the paddle 142 is in the first position 150. As may be observed from the nonexclusive illustrative example presented in FIG. 8, the moment induced into paddle 142 by elastic loop 166 when the paddle 142 is in the first position 150 tends to retain the paddle 142 in the first position 150. In some nonexclusive illustrative examples, the magnitude of the holding moment induced by the over-center condition may be selected such that a corresponding racing element 38 need only slightly contact and/or move the paddle 142 before the biasing effect of the elastic loop 166 urges the paddle towards the second position 152.

In some nonexclusive illustrative examples, the plurality of paddles 142 may be disposed in a radial array relative to the support structure 140. For example, as shown in the nonexclusive illustrative example presented in FIGS. 6-8, the plurality of paddles 142 may be disposed in a radial array relative to a display region 174, which may be configured to display an indication 146 of which of the plurality of racing elements 38 traveling along the plurality of lanes 42 was the first racing element to reach the racing order apparatus 26.

As shown in the nonexclusive illustrative example presented in FIGS. 6-8, the display region 174 may include an aperture 176 extending through the support structure 140, and each of the plurality of paddles 142 may include a display surface 178. The display surface 178 of each paddle 142 may face the aperture 176 when the paddle 142 is in the second position 152 such that the display surface 178 may be visible through the aperture 176, as suggested in FIG. 6. In some nonexclusive illustrative examples, the display surfaces 178 of the respective ones of the plurality of paddles 142 may include an indicia 180, such as one associated with the corresponding one of the plurality of lanes 42. For example, as shown in the nonexclusive illustrative example presented in FIG. 7, the indicia 180 for the first paddle 154 may include a "1" as the first paddle 154 corresponds to the first lane 44. Correspondingly, as shown in the nonexclusive illustrative example presented in FIG. 7, the indicia 180 for the second paddle 156 may include a "2," the indicia 180 for the third paddle 158 may include a "3," and the indicia 180 for the fourth paddle 160 may include a "4." In some nonexclusive illustrative examples, the indicia 180 may be suitably rotated relative to corresponding one of the plurality of paddles 142, as shown in FIG. 7, such that the indicia 180 is appropriately oriented when the display surface is visible through the aperture 176, as suggested in FIG. 6.

The racing order apparatus 26 may be configured to identify the order in which the plurality of racing elements 38 reached the racing order apparatus 26 while traveling along the plurality of lanes 42. For example, the racing order apparatus 26 may provide an indication 184, which may be a second indication, that identifies the order in which at least some of the plurality of racing elements 38 reached the racing order apparatus 26 while traveling along the plurality of lanes 42. When configured as a finish line apparatus, the second indication 184 may indicate a finishing order for the plurality of racing elements 38 that were traveling in respective ones of the lanes 42. In some nonexclusive illustrative examples, the second indication 184 may at least partially include the first indication 146.

In some nonexclusive illustrative examples, the second indication 184 may include an ordering or arrangement 186 of the paddles 142 in a racing order indicating region 188 of the racing order apparatus 26. For example, as shown in the nonexclusive illustrative example presented in FIGS. 7 and 8, the paddles 142 may from a stack 190, or be otherwise arranged, in the racing order indicating region 188 when two or more of the paddles 142 are in the second position 152. In nonexclusive illustrative examples where the paddles 142 move from the first position 150 to the second position 152 in an order corresponding to the order in which the plurality of racing elements 38 contact the respective ones of the paddles 142, the order of the paddles 142 within the stack 190 identifies the order in which the plurality of racing elements 38 reached the racing order apparatus 26 and contacted the paddles 142. When the racing order apparatus 26 is configured as a finish line apparatus, the paddles 142 may be arranged within the stack 190 in an order corresponding to the order in which the plurality of racing elements 38 reached the finish line apparatus. In nonexclusive illustrative examples where the display surfaces 178 of the plurality of paddles 142 include an indicia 180, the order in which the plurality of racing elements 38 reached the racing order apparatus 26 and contacted the paddles 142 may be readily determined from an examination of the order of the indicia 180 within the stack 190.

By way of example, the first racing element 54 may contact the first paddle 154, then the second racing element 56 may subsequently contact the second paddle 156, then the third racing element 58 may subsequently contact the third paddle 158, and finally the fourth racing element 60 may subsequently contact the fourth paddle 160. In such an example, the first 154, second 156, third 158, and fourth 160 paddles would be arranged within the stack 190 as shown or suggested in FIGS. 7-8. Further, in such an example, if the display region 174 includes an aperture 176, the indicia 180 on the display surface 178 of the first paddle 154 would face, and be visible through, the aperture 176, as suggested in FIG. 6. In such a nonexclusive illustrative example, the racing order apparatus 26 could provide one or both of a first indication 146 regarding the leading one and/or the winner of the plurality of racing elements 38 and/or a second indication 184 regarding the running and/or finishing order of the plurality of racing elements 38.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A toy raceway, comprising:

a plurality of hingedly coupled multi-lane track segments configured to foldably transition between a first configuration and a second configuration, where in the first configuration the plurality of hingedly coupled multi-lane track segments are aligned to provide a multilane toy raceway having a first end and a second end, and in the second configuration the plurality of hingedly coupled multi-lane track segments produce a stack of folded track segments;

a starting apparatus disposed proximate the first end of the toy raceway; and a finish line apparatus disposed proximate the second end of the toy raceway, wherein the finish line apparatus is configured to provide a nontransient indication of which of a plurality of racing elements first reached the finish line apparatus, wherein the nontransient indication of which of the plurality of racing elements first reached the finish line apparatus continues to exist after two or more of the plurality of racing elements have reached the finish line apparatus, and wherein:

the finish line apparatus comprises a plurality of contact members and a finishing order indicating region;

each contact member is adapted to move between first and second positions;

in the first position each contact member at least partially obstructs a corresponding one of the lanes of the multilane toy raceway;

each of the plurality of contact members is configured to move from the first position toward the second position in response to a corresponding one of the plurality of racing elements contacting the contact member while traveling in the corresponding one of the lanes; and in the second position at least a portion of the contact member is disposed in the finishing order indicating region, with the respective ones of the portions of the plurality of contact members stacked in the finishing order indicating region in an order corresponding to the order in which the plurality of racing elements contacted the respective contact members.

2. The toy raceway of claim 1, wherein the plurality of hingedly coupled multi-lane track segments comprises first, second and third multi-lane track segments, the first multi-lane track segment is hingedly coupled to the second multi-lane track segment via a first hinged connection, the second multi-lane track segment is hingedly coupled to the third multi-lane track segment via a second hinged connection, and the first and second hinged connections fold in opposite directions.

3. The toy raceway of claim 2, further comprising at least one latching member configured to at least partially retain the plurality of hingedly coupled multi-lane track segments in the second configuration.

4. The toy raceway of claim 1, wherein the starting apparatus is selectively operable to release a plurality of racing elements for travel toward the second end of the toy raceway.

5. The toy raceway of claim 4, wherein the starting apparatus is configured to selectively retain the plurality of racing elements proximate the first end of the toy raceway.

6. The toy raceway of claim 5, wherein the starting apparatus is configured to selectively simultaneously release the plurality of racing elements for travel toward the second end of the toy raceway.

7. The toy raceway of claim 1, wherein the nontransient indication of which of the plurality of racing elements first reached the finish line apparatus is a first nontransient indication, and the finish line apparatus is configured to provide a second nontransient indication identifying the order in which at least some of the plurality of racing elements reached the finish line apparatus.

8. The toy raceway of claim 1, further comprising at least one support member configured to elevate the first end of the toy raceway relative to the second end of the toy raceway, wherein the at least one support member is hingedly connected to one of the plurality of multi-lane track segments.

9. The toy raceway of claim 1, wherein each of the plurality of multi-lane track segments includes a plurality of upstanding parallel ribs configured to define a plurality of spaced apart lanes for the plurality of racing elements.

10. A finish line apparatus for a toy raceway that includes a plurality of lanes adapted to provide a racing surface for a plurality of racing elements, the finish line apparatus comprising:

a support structure extending across the plurality of lanes and having a finish order display region; and a plurality of contact members extending from the support structure and each configured for movement between first and second positions, wherein in the first position each contact member at least partially obstructs a corresponding one of the lanes, each of the plurality of contact members is configured to transition from the first position toward the second position in response to a racing element contacting the contact member while traveling in the corresponding lane, and in the second position at least a portion of the contact member is disposed in the finish order display region, with the respective portions of the plurality of contact members being nontransiently arranged in the finish order display region in an order corresponding to the order in which the racing elements contacted the respective contact elements.

11. The finish line apparatus of claim 10, wherein each of the plurality of contact members is biased toward the second position.

12. The finish line apparatus of claim 11, wherein each of the plurality of contact members is releasably retained in the first position.

13. The finish line apparatus of claim 12, wherein each of the plurality of contact members is pivotably attached to the support structure, the finish line apparatus further comprises an elastic biasing member extending between each of the plurality of contact members and the support structure, each elastic biasing member is configured to urge the corresponding contact member to pivot toward the second position, and each elastic biasing member is configured to retain the corresponding contact member in the first position via an over-center arrangement of the pivotable attachment of the contact member to the support structure relative to the corresponding elastic biasing member.

14. The finish line apparatus of claim 13, wherein the plurality of contact members are disposed in a radial array with respect to the finish order display region.

15. The finish line apparatus of claim 10, wherein the finish order display region comprises an aperture extending through the support structure, and each contact member includes a display surface facing the aperture when the contact member is in the second position.

16. The finish line apparatus of claim 10, wherein at least one of the display surfaces of the plurality of contact members includes an indicia associated with the corresponding one of the lanes.

17. The finish line apparatus of claim 10, wherein the support structure is pivotably mounted to the toy raceway proximate an end of the toy raceway.

18. A toy raceway, comprising:

a track having a first end and a second end, the track comprising:

a plurality of parallel racing surfaces;

a first track segment extending from a first end to a second end; and a second track segment extending from a first end to a second end, wherein the second end of the first track segment is pivotably connected to the first end of the second track segment, and the first track segment is configured to pivot relative to the second track segment about a first axis that is parallel to the racing surfaces;

a starting apparatus disposed proximate the first end of the track, wherein the starting apparatus is configured to simultaneously release a plurality of vehicles for travel along the plurality of parallel racing surfaces; and a racing order apparatus disposed intermediate the starting apparatus and the second end of the track, the racing order apparatus comprising:

a support structure pivotably mounted to one of the first and second track segments and having a racing order indicating region; and a plurality of paddles pivotably mounted to the support structure, wherein each paddle is adapted to pivot between first and second positions, in the first position each paddle at least partially obstructs a corresponding one of the parallel racing surfaces, each of the plurality of paddles is configured to move from the first position toward the second position in response to one of the vehicles contacting the paddle while traveling on the corresponding racing surface, and in the second position at least a portion of the paddle is disposed in the racing order indicating region, with the respective ones of the portions of the plurality of paddles being nontransiently arranged in the racing order indicating region in an order corresponding to the order in which the plurality of vehicles contacted the respective paddles.

19. The toy raceway of claim 18, wherein the track includes a third track segment extending from a first end to a second end, the second end of the second track segment is pivotably connected to the first end of the third track segment, the third track segment is configured to pivot relative to the second track segment about a second axis that is parallel to the first axis, the first track segment is configured to pivot relative to the second track segment in a first rotational direction, the third track segment is configured to pivot relative to the second track segment in a second rotational direction, and the second rotational direction is opposite the first rotational direction.

20. The finish line apparatus of claim 10, wherein the respective portions of the plurality of contact members are stacked in the finish order display region in an order corresponding to the order in which the racing elements contacted the respective contact elements to provide a nontransient indication of the order in which the racing elements contacted the respective contact elements.

21. The toy raceway of claim 18, wherein the respective ones of the portions of the plurality of paddles are stacked in the racing order indicating region in an order corresponding to the order in which the plurality of vehicles contacted the respective paddles to provide a nontransient indication of the order in which the plurality of vehicles contacted the respective paddles.

* * * * *